US008661974B2

(12) United States Patent
Chen

(10) Patent No.: US 8,661,974 B2
(45) Date of Patent: Mar. 4, 2014

(54) MOVING-OUT AND ADJUSTMENT DEVICE FOR SCREEN

(75) Inventor: Tung-Chin Chen, Taipei (TW)

(73) Assignee: Atma Champ Enterise Corporation, Taipei (TW)

( * ) Notice: Subject to any disclaimer, the term of this patent is extended or adjusted under 35 U.S.C. 154(b) by 302 days.

(21) Appl. No.: 13/240,203

(22) Filed: Sep. 22, 2011

(65) Prior Publication Data

US 2013/0074715 A1 Mar. 28, 2013

(51) Int. Cl.
*B05C 17/06* (2006.01)

(52) U.S. Cl.
USPC ..... 101/127.1; 101/126

(58) Field of Classification Search
USPC ..... 101/114, 123, 124, 126, 127, 127.1, 101/129
See application file for complete search history.

(56) References Cited

U.S. PATENT DOCUMENTS 4,195,567 A * 4/1980 Mitter ..... 101/115
5,107,760 A * 4/1992 Pratt ..... 101/115
6,065,399 A * 5/2000 Eppinger ..... 101/127.1
6,101,938 A * 8/2000 Adams ..... 101/126
7,047,879 B2 * 5/2006 Chen ..... 101/126
7,337,718 B2 * 3/2008 Chen ..... 101/126
2004/0149152 A1 * 8/2004 Edson ..... 101/127
2005/0223919 A1 * 10/2005 Oleson ..... 101/127.1

* cited by examiner

*Primary Examiner* — Ren Yan
(74) *Attorney, Agent, or Firm* — Muncy, Geissler, Olds & Lowe, P.C.

(57) ABSTRACT

A moving-out and adjustment device for screens is revealed. The moving-out and adjustment device is applied to screen printing machines and having a frame, two sliding member and an adjustment mechanism. The frame consists of an upper frame and a lower frame. The two sliding members are disposed on two sides of the upper frame symmetrically and a screen is mounted between the two sliding members. Thus the screen is moved from a printing position of a screen printing machine horizontally by the sliding members. The bending and deformation of the screen can be avoided. The adjustment mechanism is arranged at the frame and having a first moving unit and a second moving unit. By operating the first moving unit and the second moving unit, the upper frame is moved in both the X direction and the Y direction in the X-Y plane in relation to the lower frame.

16 Claims, 10 Drawing Sheets

MOVING-OUT AND ADJUSTMENT DEVICE FOR SCREEN

BACKGROUND OF THE INVENTION

The present invention relates to a moving-out and adjustment device for screens, especially to a moving-out and adjustment device for screens that make a screen move out horizontally from screen printing machines without deformation and adjusts the position of the screen on the X-Y plane.

In a screen printing machine available now, a screen is stretched over a frame and placed between a screening printing unit and a table. By the screening printing unit, ink passes through the screen to be applied to objects to be printed on the table.

Generally the screen printing is tempered by an adjustment device so that the screen is located at a right position of the screening printing machine for printing. While running screening printing, ink is often infiltrated and attached to fabric of the screen. Sometimes even small particles are attached to the fabric of the screen. These have negative effects on the quality of screen printing. Thus periodic cleaning is required to maintain acceptable print quality.

A conventional screen printing machine includes a to-and-fro adjusting member and a left-and-right adjusting member respectively for control of the forward and backward movement and the left and right movement of the screen. However, such design has a shortcoming of increasing adjustment time because the forward and backward movement and the left and right movement are unable to be adjusted at the same time. Thus the production efficiency is reduced. This leads to negative effect on the applications of screen printing.

Moreover, a distance between the screen and the table is quite narrow and this is not convenient for cleaning of the screen. Thus some screen printing machines are design to have a lifted/pivotal/moveable screen printing unit or the screen is able to be pulled outward. Yet the above two ways bring inconvenience in operation. Moreover, while the screen printing unit is pivoted upward, it may sway and cause damages to users without proper support. As to the pull-out design, the shortcoming is the deformation of the screen due to insufficient support while being pulled outward. Especially the large-scale screen, the deformation is more severe.

Thus there is room for improvement and a need to provide a screen that has simple structure suitable for mass production and prevents deformation during movement. Moreover, the operation of the screen is not only fast and precise but also fast and convenient.

SUMMARY OF THE INVENTION

Therefore it is a primary object of the present invention to provide a moving-out and adjustment device for screens that moves a screen out and adjusts positions of the screen for convenient and time-saving cleaning of the screen. Moreover, the bending and deformation of the screen while being moved from a screen printing machine can be avoided.

It is another object of the present invention to provide a moving-out and adjustment device for screens that controls movement of the screen in the X direction and in the Y direction in the X-Y plane. The movement in both directions can be adjusted at the same time. Thereby more convenience of operation is provided, working time is saved and working efficiency is improved.

BRIEF DESCRIPTION OF THE DRAWINGS

FIG. 9 is an enlarged perspective view of a

DETAILED DESCRIPTION OF THE PREFERRED EMBODIMENT

Figure 1:
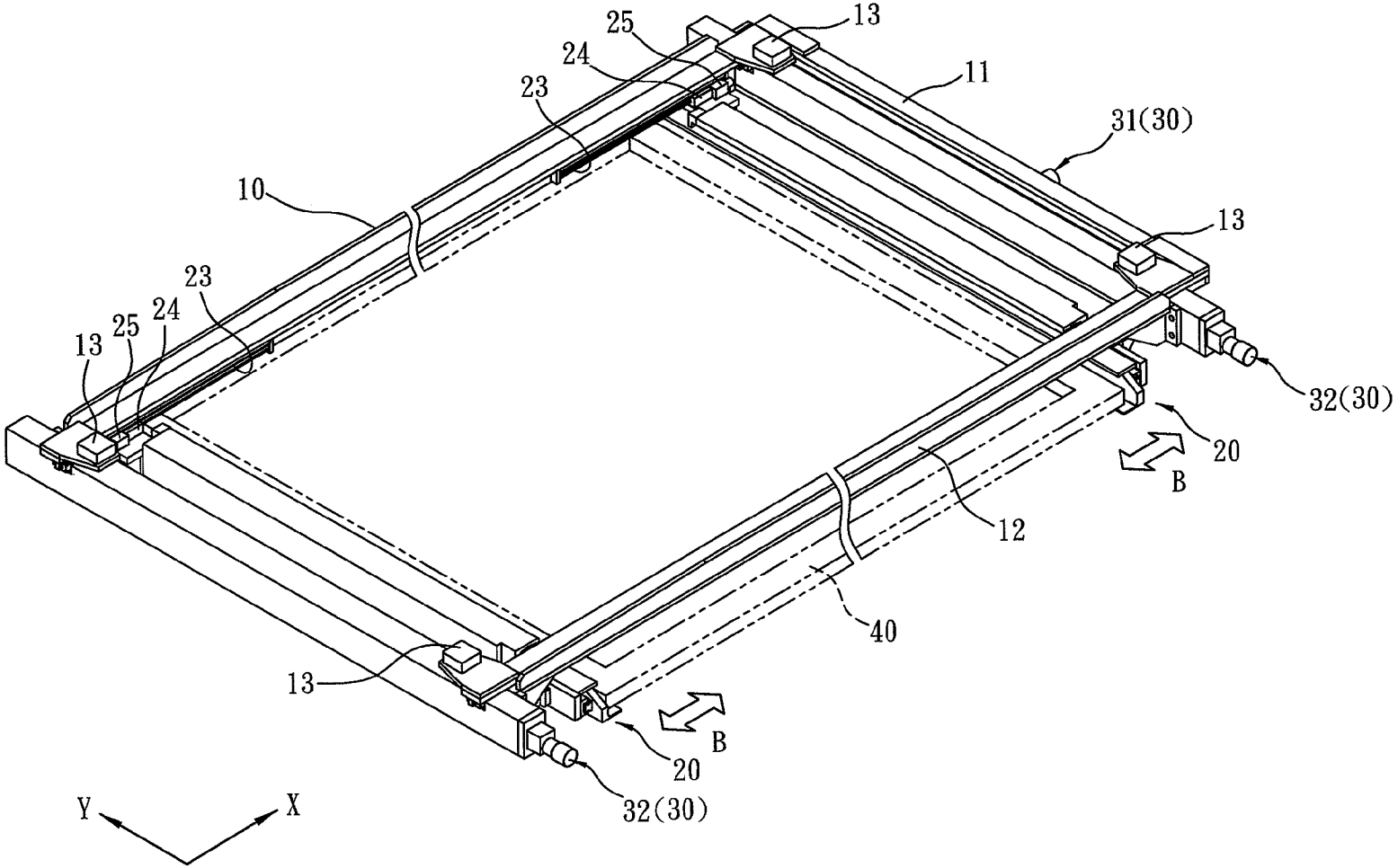
FIG. 1 is a perspective view of an embodiment of a moving-out and adjustment device for screens according to the present invention.
Figure 2:
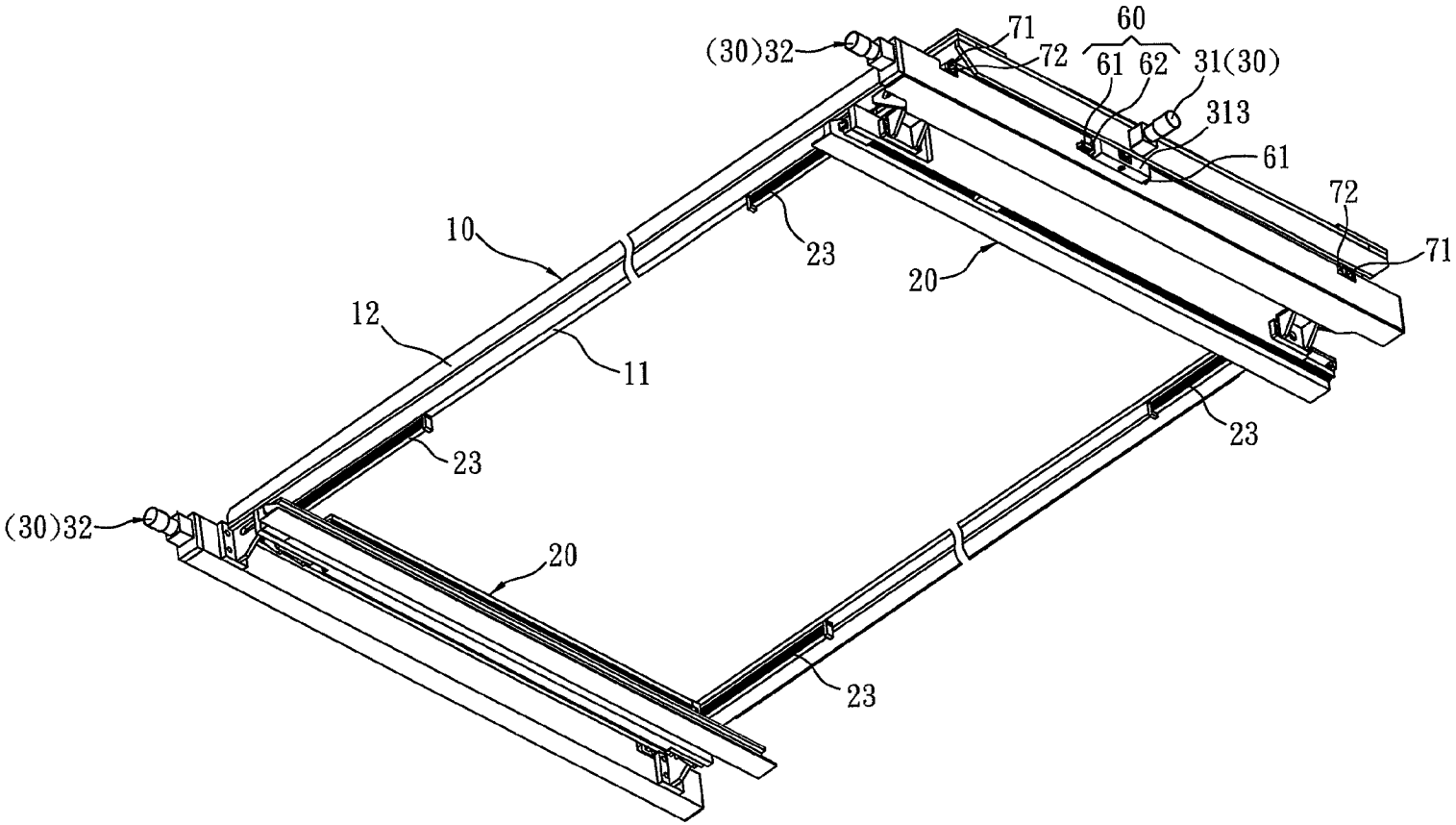
FIG. 2 is another perspective view showing a bottom of an embodiment of a moving-out and adjustment device for screens according to the present invention viewed from another angle.
Figure 3:
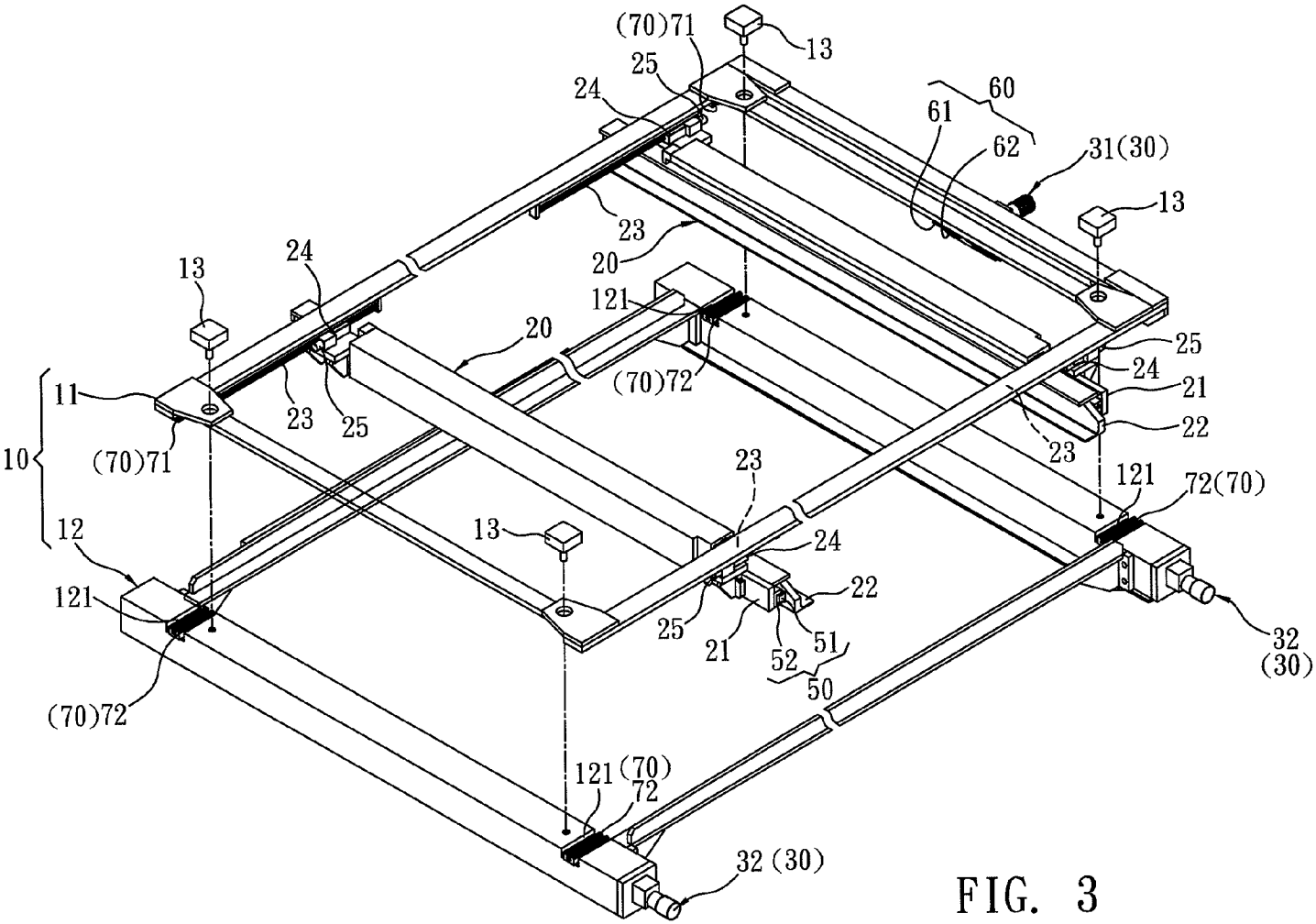
FIG. 3 is an explosive view of an embodiment of a moving-out and adjustment device for screens according to the present invention.

Refer from FIG. 1 to FIG. 3, a moving-out and adjustment device for screens is applied to screen printing machines. The moving-out and adjustment device for screens includes a frame 10, two sliding members 20, and an adjustment mechanism 30. The frame 10 is rectangular and having an upper frame 11 and a lower frame 12. Each corner of the frame 10 is disposed with a pneumatic cylinder 13 so as to position and assembly the upper frame 11 with the lower frame 12. The lower frame 12 is fixed while the upper frame 11 is movable in relation to the lower frame 12. The two sliding members 20 are arranged at a left side and a right side of the upper frame 11 symmetrically. A screen 40 is assembled between the two sliding members 20 and is moved out horizontally by the sliding members 20, as indicated by an arrow A in FIG. 6. The adjustment mechanism 30 is assembled on the frame 10 and is used to control the movement of the upper frame 11 in the X direction and in the Y direction in the X-Y plane in relation to the lower frame 12. The adjustment mechanism 30 also allows the two sliding members 20 moving with the screen 40 synchronously.

Figure 4:
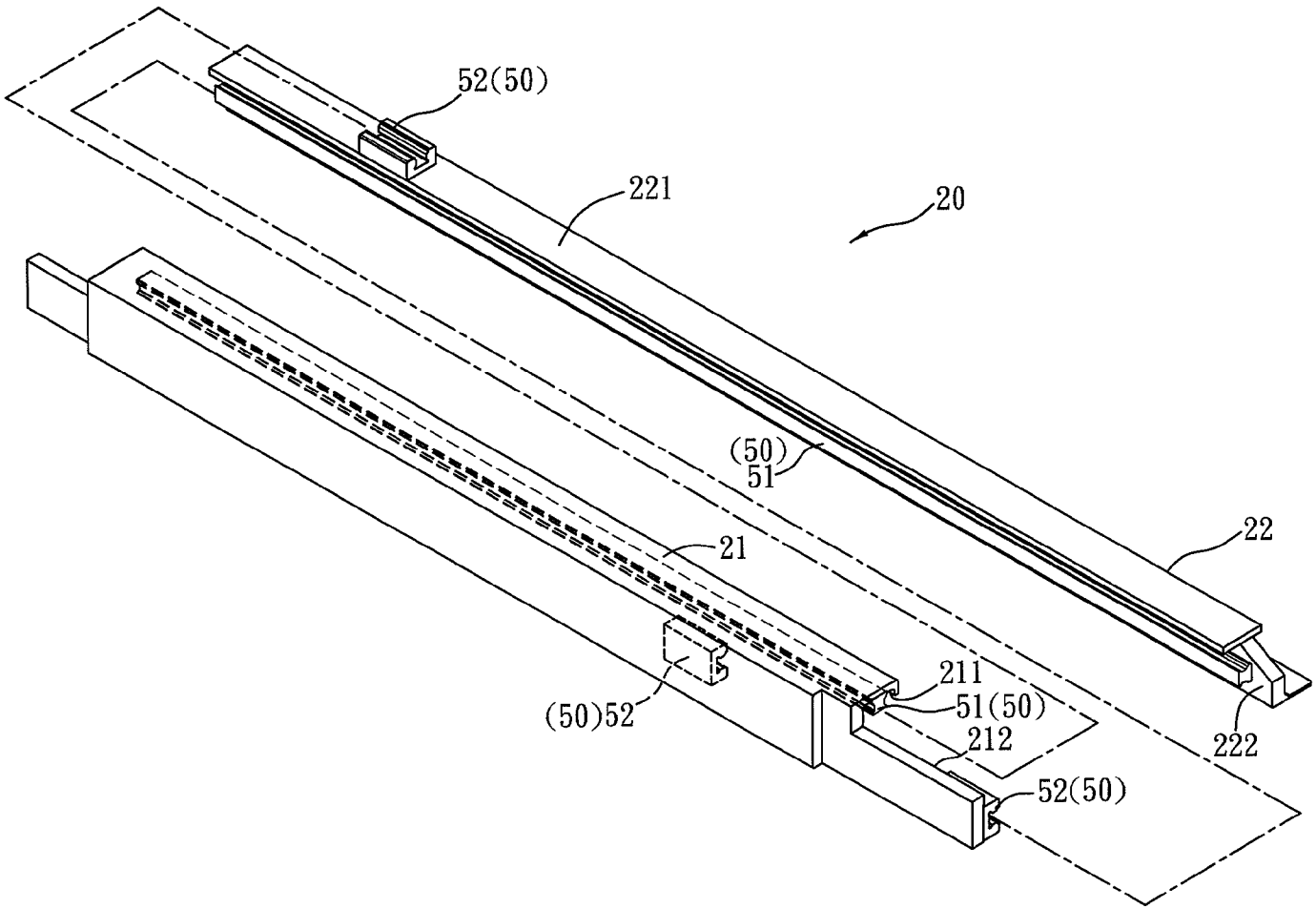
FIG. 4 is an explosive view of an embodiment of a sliding member according to the present invention.
Figure 5:
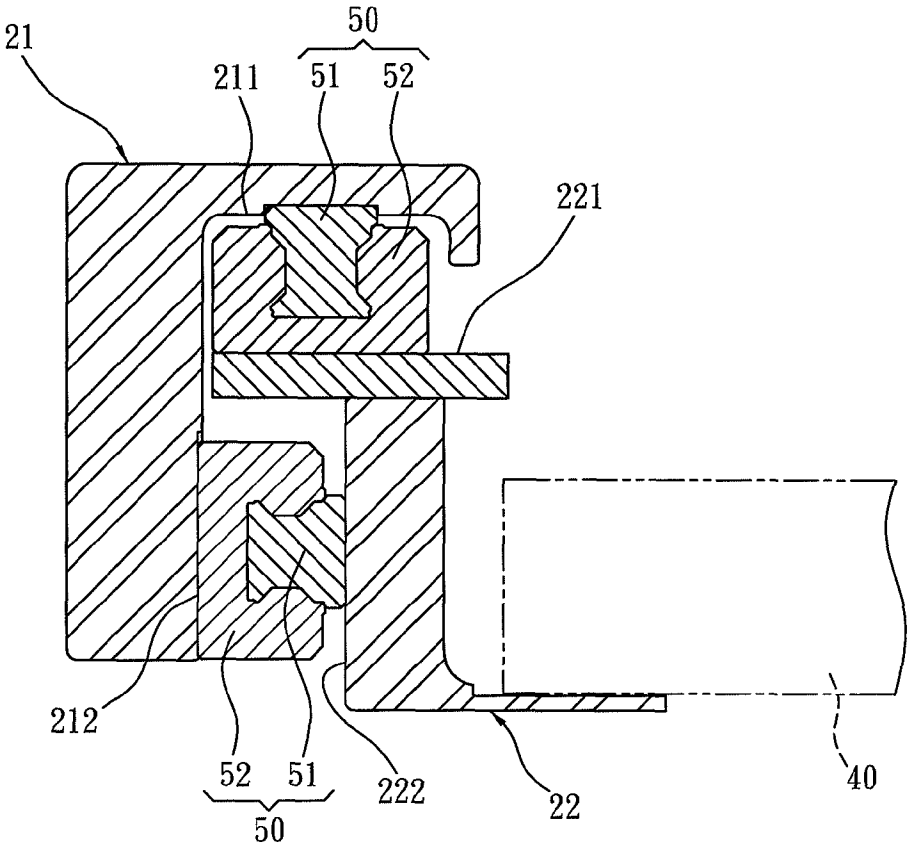
FIG. 5 is an enlarged cross sectional view of an embodiment of a sliding member according to the present invention.

Refer from FIG. 3 to FIG. 5, the sliding member 20 consists of a fixing base 21 and a sliding seat 22. The fixing base 21 is fixed on and disposed under the upper frame 11. A top surface 221 and an outer end surface 222 of the sliding seat 22 and their corresponding surfaces of the fixing base 21 are respectively arranged with a guiding rail part 50, allowing the sliding seat 22 sliding forward and backward in relation to the fixing base 21. The guiding rail part 50 also provides a better support and improves sliding stability.

Figure 8:
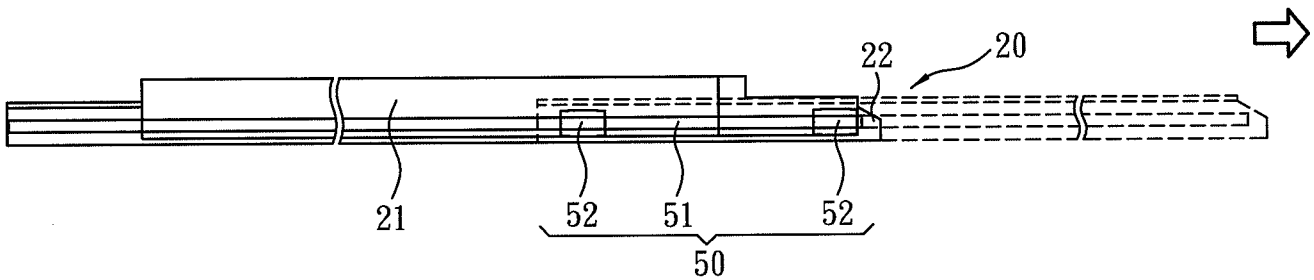
FIG. 8 is a schematic drawing showing a side view of an embodiment of a sliding member being moved from a printing position according to the present invention.
Figure 9:
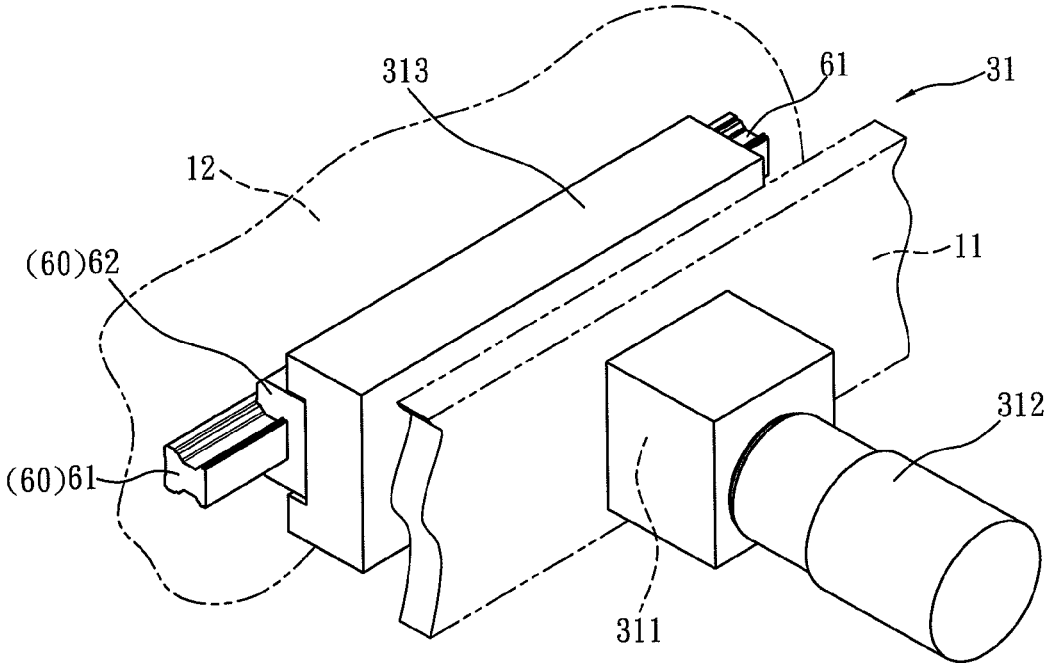
Figure 10:
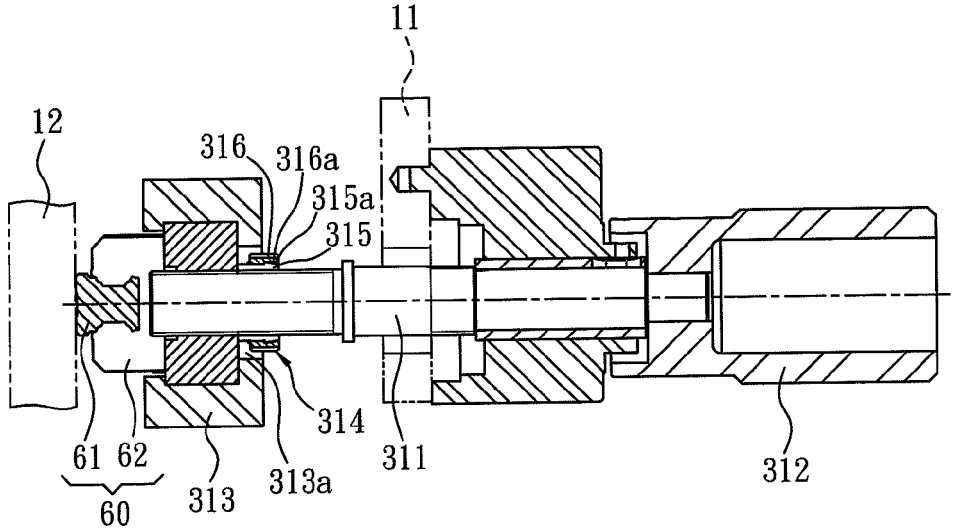
FIG. 10 is a cross sectional view of the embodiment in FIG. 9.
Figure 11:
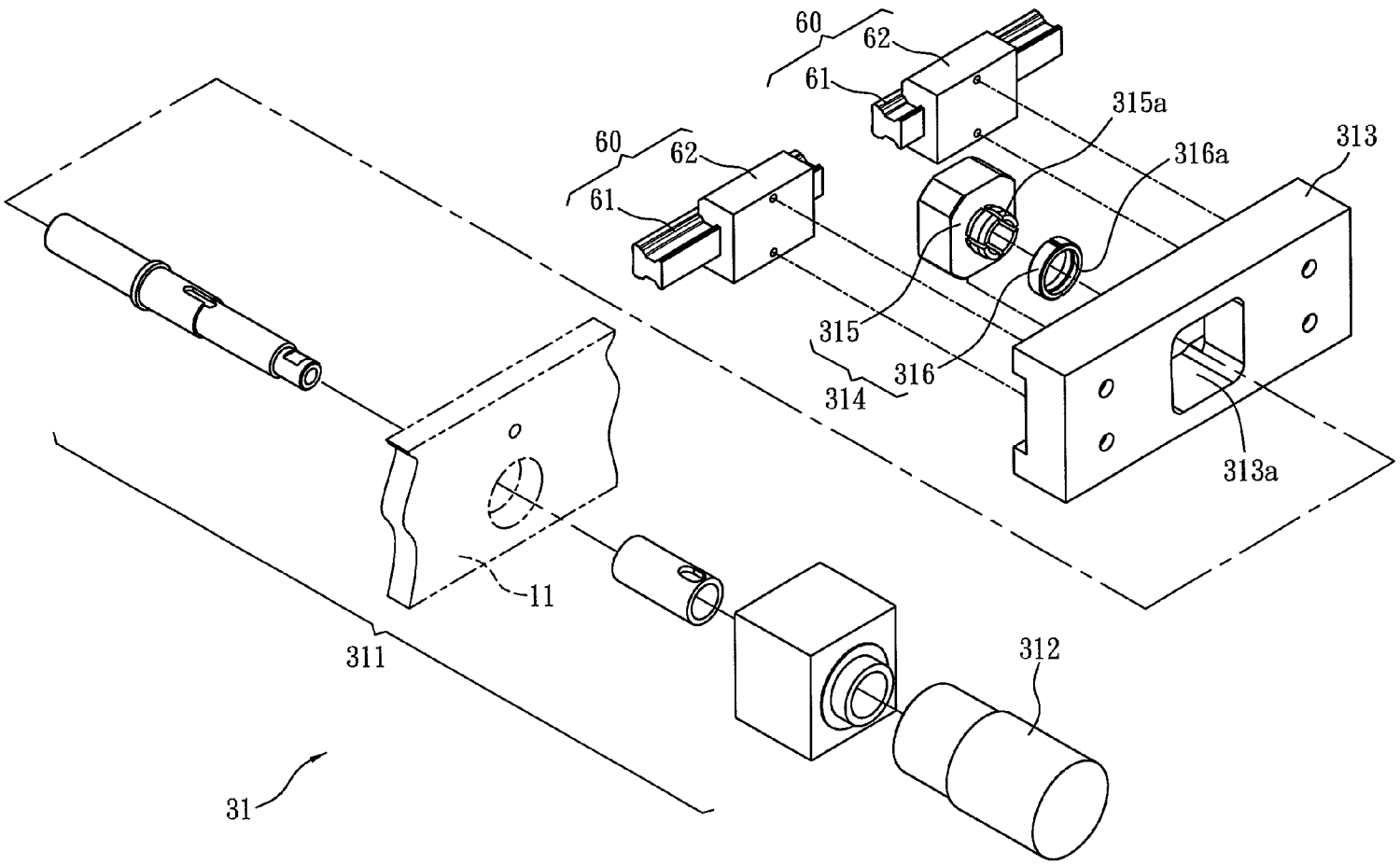
FIG. 11 is an explosive view of the embodiment in FIG. 9.

The guiding rail part 50 is composed of a guiding rail 51 and at least one guiding slot 52 that allows the guiding rail 51 sliding therein. The guiding rail 51 and the guiding slot 52 are respectively arranged at the top surface 221 and the outer end surface 22 of the sliding seat 22. They are also disposed on corresponding surfaces of the fixing base 21, as shown in FIG. 4 and FIG. 5. The positions of guiding rail 51 and the guiding slot 52 can be interchanged. That means the guiding slot 52 and the guiding rail 51 are respectively arranged at the top surface 221 and the outer end surface 22 of the sliding seat 22. They are also set on the corresponding surfaces of the fixing base 21 (not shown in figures). For example, refer to FIG. 4 and FIG. 8, the guiding rail part 50 includes the guiding rail 51 and the two guiding slots 52. The guiding rail 51 is disposed on the outer end surface 222 of the sliding seat 22 and the guiding slots 52 are arranged at the surface of the fixing base 21 corresponding to the outer end surface 222 of the sliding seat 22. Thereby the guiding rail part 50 provides the guiding rail 51 better support and improves sliding stability while the guiding rail 51 sliding within each guiding slot 52.

Refer to FIG. 4 and FIG. 5, the cross section of the fixing base 21 of the sliding member 20 is inverted L-shaped while the cross section of the sliding seat 22 is L-shaped. The top surface 221 and the outer end surface 222 of the sliding seat 22 are respectively corresponding to an inner top surface 211 and an inner end surface 212 of the fixing base 21. Each guiding rail part 50 is arranged at the two vertical surfaces and the two horizontal surfaces of the fixing base 21 and the sliding seat 22 respectively. The guiding rail 51 of the guiding rail part 50 is disposed on the outer end surface 222 of the sliding seat 22 while the guiding slot 52 is arranged at the inner end surface 212 of the fixing base 21, as shown in FIG. 5. Or the guiding rail 51 is disposed on the inner end surface 212 of the fixing base 21 and the guiding slot 52 is arranged at the outer end surface 222 of the sliding seat 22 (not shown in figure). And the other guiding slot 52 is set on the top surface 221 of the sliding seat 22 while the other guiding rail 51 is arranged at the inner top surface 211 of the fixing base 21. Or the other guiding rail 51 is disposed on the top surface 221 of the sliding seat 22 and the other guiding slot 52 is arranged at the inner top surface 211 of the fixing base 21 (not shown in figure).

The guiding rail part 50 is disposed between two corresponding horizontal surfaces of the fixing base 21 and of the sliding seat 22 respectively. Compared with conventional structure, the present invention provides better support and improves stability of sliding between the fixing base 21 and the sliding seat 22. Moreover, the bending and deformation of the sliding member 20 during the movement of screen 40 out of the printing position of the screen printing machine is avoided.

Figure 6:
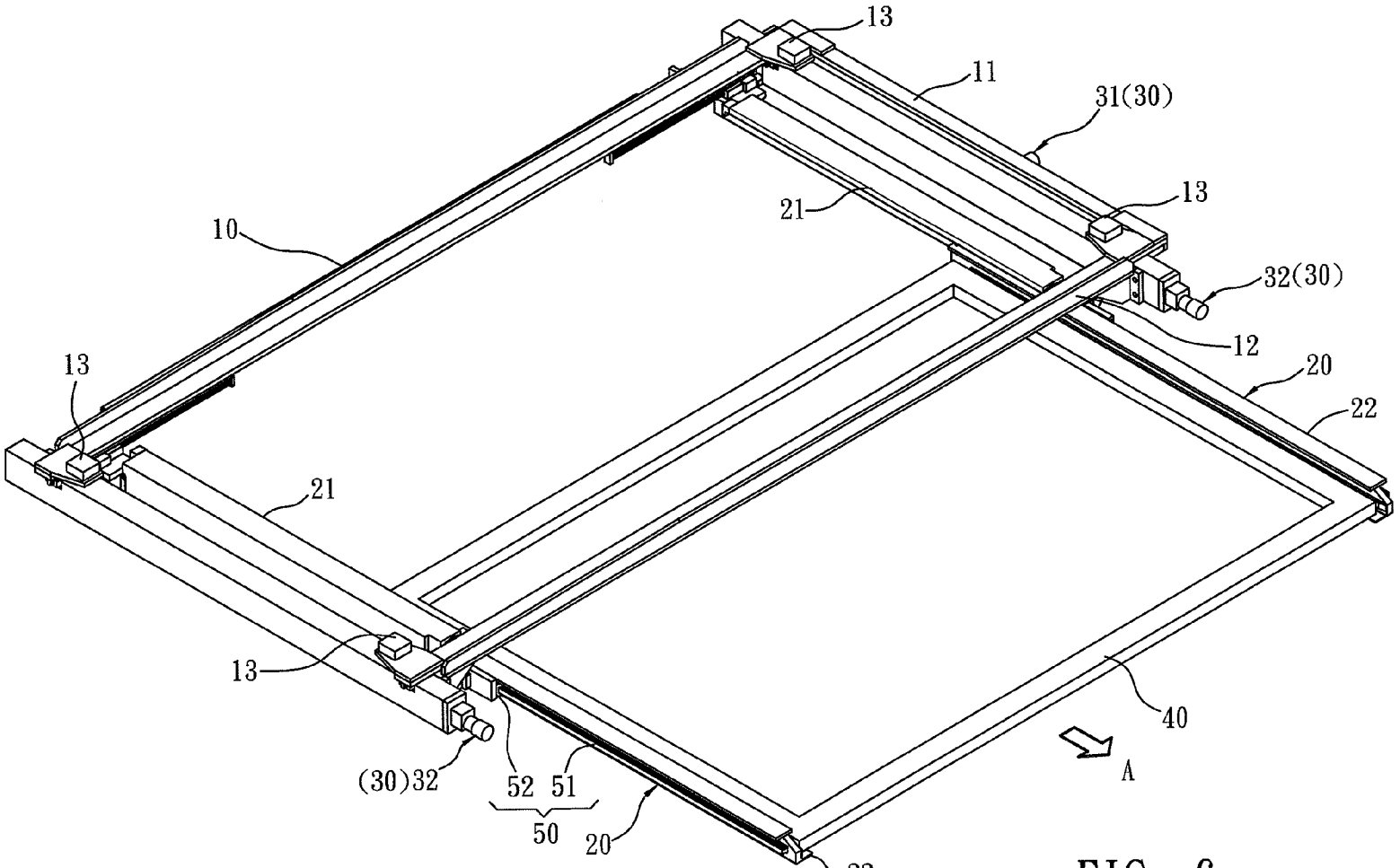
FIG. 6 is a schematic drawing showing a screen being moved out by the sliding member according to the present invention.
Figure 7:
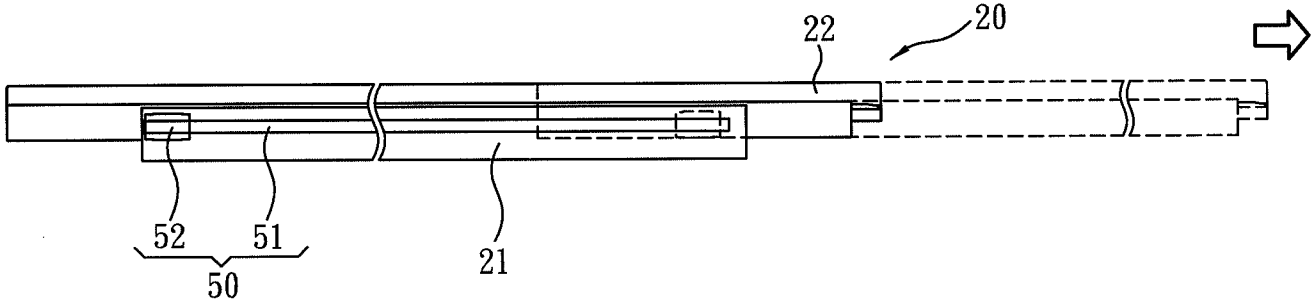
FIG. 7 is a schematic drawing showing a top view of an embodiment of a sliding member being moved from a printing position according to the present invention.

Refer to FIG. 1, FIG. 6, FIG. 7, and FIG. 8, in the sliding member 20, the sliding seat 22 slides in relation to the fixing base 21 so as to move the screen 40 out from a printing position of a screen printing machine, as indicated by an arrow A in FIG. 6 for cleaning the screen 40. When users intend to clean the screen 40, they move the screen 40 out in the direction indicated by the arrow A by the sliding member 20. After finishing cleaning, the screen 40 is moved into the printing position of the screen printing machine and the printing process continues. The operation is easy, safe and the working time is reduced.

Back to FIG. 1, a sliding rail 23 and a sliding slot 24, corresponding to each other, are arranged at surfaces of the upper frame 11 that are corresponding to a front end and a rear end of the fixing base 21 of each sliding member 20. Thus the sliding member 20 is moved leftward and rightward (in the X direction) in relation to the upper frame 11, as indicated by an arrow B in FIG. 1. Thus the distance between the two sliding members 20 can be adjusted so as to mount the screen 40 with different sizes. Moreover, the front end and the rear end of the fixing base 21 of the sliding member 20 are respectively arranged with a sliding rail brake 25 that provides a braking force to clamp and fix the sliding member 20 firmly on the sliding rail 23 set on the upper frame 11.

The sliding member 20 not only makes the moving-in and moving-out of the screen 40 become easier and this is beneficial to the screen 40 cleaning. The sliding member 20 also provides better support so as to avoid bending and deformation of the screen during the movement of the screen 40.

Refer to FIG. 1, FIG. 2, FIG. 3, FIG. 9, FIG. 10, FIG. 11, and FIG. 12, the adjustment mechanism 30 consists of first moving unit 31, and two second moving units 32, respectively arranged at each side of the frame 10. The side of the frame 10 disposed with the first moving unit 31 is perpendicular with the side arranged with the second moving unit 32. The first moving unit 31, and the second moving unit 32 are used to control movement of the upper frame 11 in the X direction and the Y direction in the X-Y plane in relation to the lower frame 12, and thus the screen 40 is driven to move synchronously. As shown in FIG. 1 and FIG. 2, the first moving unit 31 is disposed on the right side of the frame 10 or the left side of the frame 10 (not shown in figure) for control of the movement of the upper frame 11 in the X direction in the X-Y plane in relation to the lower frame 12. The two second moving units 32 are arranged at the front side or the rear side (not shown in figure) for control of the movement of the upper frame 11 in the Y direction in the X-Y plane in relation to the lower frame 12.

As shown in FIG. 3, FIG. 9, FIG. 10, and FIG. 11, the first moving unit 31 set on the right side of the frame 10 includes a first transmission part 311, an adjustment button 312, a base body 313 and a sleeve assembly 314. One end of the first transmission part 311 is passed through the right side of the upper frame 11 to connect with the adjustment button 312 while the other end thereof is passed through and assembled with the base body 313 by the sleeve assembly 314. The adjustment button 312 can be operated and rotated for turning the first transmission part 311 to move forward and backward. And the upper frame 11 is moved along with the first transmission part 311 synchronously. An insertion hole **313*a* is set on a center of the base body 313, allowing the first transmission part 311 to pass through. The sleeve assembly 314 consists of an inner sleeve 315 and an outer sleeve 316. The inner sleeve 315 is threaded and connected with the first transmission part 311. The inner sleeve 315 includes a ramp part 315*a*. The outer sleeve 316 is arranged with a slope part 316*a* and placed around the inner sleeve 315. Thus the ramp part 315*a* of the inner sleeve 315 is in contact with the slope part 316*a* of the outer sleeve 316 tightly. The ramp part 315*a* and the slope part 316*a*** are contacted slope-to-slope so as to get rid of a gap between threads. Therefore the precision of the movement is improved.

The first moving unit 31 is connected to the lower frame 12 by a first sliding unit 60. The first sliding unit 60 is composed of at least one sliding rail 61 and at least one sliding slot 62, corresponding to each other. The sliding rail 61 is disposed on the right side of the lower frame 12 while the sliding slot 62 is arranged at the base body 313 of the first moving unit 31. The position of the sliding rail 61 and the position of the sliding slot 62 can be interchanged. That means the sliding rail 61 is disposed on the base body 313 of the first moving unit 31 and the sliding slot 62 is arranged at the right side of the lower frame 12 (not shown in figure).

Figure 12:
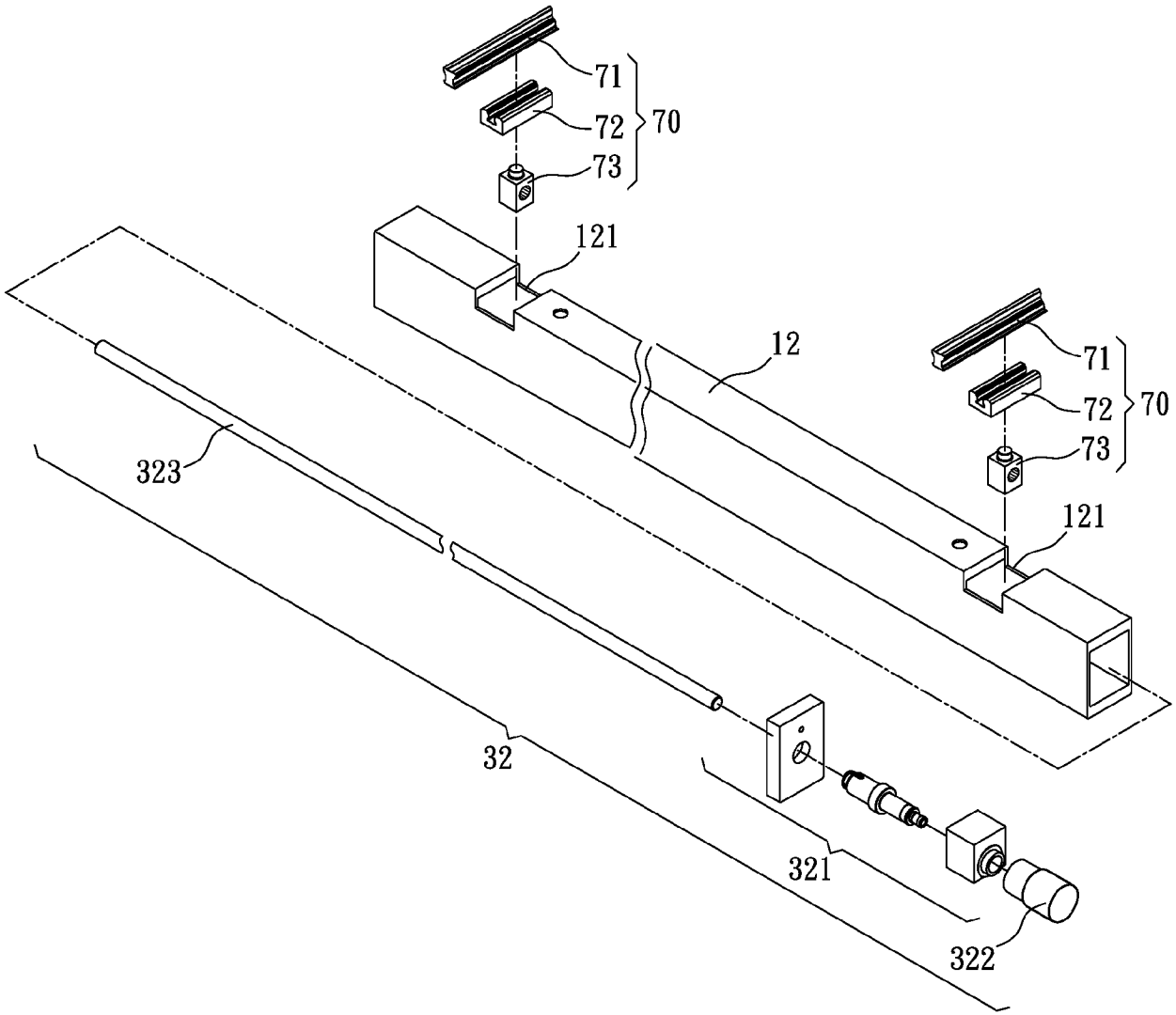
FIG. 12 is a partial enlarged explosive view of the embodiment in FIG. 3.

Refer to FIG. 3 and FIG. 12, the two second moving units 32 are respectively mounted on the left side and the right side of the lower frame 12. The second moving unit 32 consists of a second transmission part 321, an adjustment button 322 and a bar 323. One end of the second transmission part 321 is connected to the adjustment button 322 while the other end thereof is connected to one end of the bar 323. By rotating the adjustment button 322 clockwise and counterclockwise, the second transmission part 321 is driven to rotate and lead the bar 323 moving forward and backward.

The second moving unit 32 is connected to the upper frame 11 by a plurality of second sliding units 70. The second sliding units 70 are symmetrically arranged at corresponding surfaces of the front end and the rear end of the left and right sides of the upper frame and the lower frame 12. The second sliding unit 70 includes a sliding rail 71, a sliding slot 72 and a base seat 73. The sliding rail 71 is disposed on the bottom of the upper frame 11 while the sliding slot 72 is fixed on top of the base seat 73 and mounted in an open slot 121 of the lower frame 12. The base seat 73 is placed around and fixed on the bar 323. The size of the open slot 121 is larger than the size of the sliding slot 72 so that the sliding slot 72 can be moved to-and-fro along with the bar 323 inside the open slot 121. Moreover the position of the sliding rail 71 and the position of the sliding slot 72 can be interchanged. The sliding slot 72 is disposed on the bottom of the upper frame 11 while the sliding rail 71 is fixed on top of the base seat 72 and mounted in the open slot 121 of the lower frame 12 (not shown in figure). In the embodiment shown in FIG. 3, the number of the second sliding unit 70 is four. The number of the second sliding unit 70 is not limited, it can be two or six.

While rotating the adjustment button 312 of the first moving unit 31, the upper frame 11 is driven to move forward or backward by the first transmission part 311. The lower frame 12 is fixed so that the upper frame 11 is moved along the X axis in the X-Y plane in relation to the lower frame 12 by the sliding rail 71 and the sliding slot 72 of the second sliding unit 70. Moreover, the gap between the base body 313 and the first transmission part 311 of the first moving nit 31 is eliminated due to pressing from contact of the ramps between the inner sleeve 315 and the outer sleeve 316. Thus the displacement (distance traveled) of the upper frame 11 in relation to the lower frame 12 is adjusted precisely.

While rotating the adjustment button 322 of the second moving unit 31, the bar 323 is driven to move forward or backward by the second transmission part 321. The second sliding unit 70 is further driven by the bar 323 to move so that the sliding slot 72 of the second sliding unit 70 in the open slot 121 of the lower frame 12 is moving forward and backward along the bar 323. The lower frame 12 is fixed so that the upper frame 11 the upper frame 11 is moved in the Y direction in the X-Y plane in relation to the lower frame 12 by the sliding rail 61 and the sliding slot 62 of the first sliding unit 60, without being affected by the movement of the first moving unit 31.

The first moving unit 31 and the second moving unit 32 can work and move independently or together with each other. Thus the upper frame 11 can move along both the X axis and the Y axis in the X-Y plane in relation to the lower frame 12. Thereby the screen 40 is moved more conveniently, the working time is reduced, and the working efficiency is improved. The present invention meets the requirements of mass-production and industrial applications.

Compared with the conventional structure, the present invention has following advantages:

1. The sliding member of the present invention features on easy and simple operation, and better support. Thus the sliding during the movement of the screen is more stable. Moreover, the screen will not have bending and deformation after being moved out.

2. The adjustment mechanism of the present invention has easy and fast operation, and synchronous movement of the screen in both X and Y directions. Thus the working time is reduced, the efficiency is improved and this favors mass-production.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A moving-out and adjustment device for screens of screen printing machines comprising:

a frame having an upper frame and a lower frame;

two sliding members that are disposed symmetrically on two sides of the upper frame and are used for mounting a screen therebetween; each sliding member having:

a fixing base disposed under the upper frame; and a sliding seat in which a top surface and an outer end surface thereof, together with corresponding surfaces of the fixing base are respectively arranged with a guiding rail part; the sliding seat sliding in relation to the fixing base by the guiding rail part so as to move the screen in and out horizontally; the guiding rail part having a guiding rail and at least one guiding slot; and an adjustment mechanism including:

a first moving unit that is disposed on one side of the upper frame and is connected to the lower frame by a first sliding unit so as to control movement of the upper frame in the X direction in the X-Y plane in relation to the lower frame; and two second moving units that are respectively disposed on two sides of the lower frame and the two sides of the lower frame are perpendicular to the side of the upper frame disposed with the first moving unit; the two second moving units are connected to the upper frame by a plurality of second sliding units and are used to control movement of the upper frame in the Y direction in the X-Y plane in relation to the lower frame;

wherein the upper frame is controlled to move in the X direction and in the Y direction in the X-Y plane in relation to the lower frame at the same time by operating the first moving unit and the second moving units.

2. The device as claimed in claim 1, wherein the guiding rail and the guiding slot are respectively arranged at the outer end surface of the sliding seat and a surface of the fixing base corresponding to the outer end surface.

3. The device as claimed in claim 1, wherein the guiding rail and the guiding slot are respectively disposed on the top surface of the sliding seat and a surface of the fixing base corresponding to the top surface.

4. The device as claimed in claim 1, wherein a cross section of the fixing base of the sliding member is inverted L-shaped.

5. The device as claimed in claim 1, wherein a cross section of the sliding seat of the sliding member is L-shaped.

6. The device as claimed in claim 1, wherein a sliding rail and a corresponding sliding slot are respectively arranged at surfaces of the upper frame that are corresponding to a front end and a rear end of the fixing base so that the sliding members are moved leftward and rightward in relation to the upper frame.

7. The device as claimed in claim 6, wherein a sliding rail brake is disposed on the front end and on the rear end of the fixing base of the sliding member so as to clamp and fix the sliding members firmly on the sliding rail arranged at the upper frame.

8. The device as claimed in claim 1, wherein the first moving unit includes a first transmission part, an adjustment button, a base body and a sleeve assembly; one end of the first transmission part is passed through one side of the upper frame to connect with an adjustment button while the other end thereof is passed through the base body, threaded with the sleeve assembly and assembled with the base body by the sleeve assembly; the base body is set with an insertion hole on a center thereof, allowing the first transmission part to pass through and the sleeve assembly to be mounted therein; the first transmission part is driven to move forward and backward by rotating the adjustment button and the upper frame is moved forward or backward synchronously.

9. The device as claimed in claim 8, wherein the sleeve assembly includes an inner sleeve and an outer sleeve; the inner sleeve with a ramp part is threaded with the first transmission part and is fixed in the insertion hole of the base body; the outer sleeve having a slope part is sleeved on the inner sleeve so that the slope part of the outer sleeve is in contact with the ramp part of the inner sleeve closely.

10. The device as claimed in claim 8, wherein the first sliding unit includes at least one sliding rail disposed on an outer surface of a right side or an outer surface of a left side of the lower frame, and at least one sliding slot that is arranged at the base body of the first moving unit; the sliding rail is sliding within the sliding slot.

11. The device as claimed in claim 1, wherein the plurality of second sliding units is symmetrically arranged at corresponding surfaces of front and rear ends on left and right sides of the upper frame and the lower frame.

12. The device as claimed in claim 1, wherein each of the second moving units includes a second transmission part whose one end is connected to an adjustment button and the other end thereof is connected to one end of a bar; by rotating the adjustment button clockwise and counterclockwise, the second transmission part is driven to rotate and further drive the bar to move forward and backward.

13. The device as claimed in claim 12, wherein each of the plurality of second sliding units includes a sliding rail, a sliding slot and a base seat; the sliding rail is disposed on a bottom of the upper frame while the sliding slot is fixed on top of the base seat and mounted in a corresponding open slot set on the lower frame; the base seat is placed around and fixed on the bar so that the sliding slot is moved forward and backward along with the bar inside the open slot.

14. The device as claimed in claim 1, wherein the number of second sliding units is four.

15. The device as claimed in claim 1, wherein the frame is a rectangular frame.

16. The device as claimed in claim 1, wherein each corner of the frame is disposed with a pneumatic cylinder so as to position and assembly the upper frame with the lower frame.

* * * * *